US006405163B1

(12) United States Patent
Laroche

(10) Patent No.: US 6,405,163 B1
(45) Date of Patent: Jun. 11, 2002

(54) PROCESS FOR REMOVING VOICE FROM STEREO RECORDINGS

(75) Inventor: Jean Laroche, Santa Cruz, CA (US)

(73) Assignee: Creative Technology Ltd., Singapore (SG)

( * ) Notice: Subject to any disclaimer, the term of this patent is extended or adjusted under 35 U.S.C. 154(b) by 0 days.

(21) Appl. No.: 09/405,941

(22) Filed: Sep. 27, 1999

(51) Int. Cl.[7] ..... G10L 11/00; G10H 1/06; H04R 5/04

(52) U.S. Cl. ..... 704/205; 84/616; 381/2

(58) Field of Search ..... 704/205, 500; 381/1, 2, 107; 84/616, 654

(56) References Cited

U.S. PATENT DOCUMENTS

| | | | | | |
|---|---|---|---|---|---|
| 5,400,410 | A | * | 3/1995 | Muraki et al. | 381/107 |
| 5,511,128 | A | | 4/1996 | Lindemann et al. | 381/92 |
| 5,541,999 | A | * | 7/1996 | Hirai | 381/2 |
| 5,550,920 | A | * | 8/1996 | Nomura | 381/17 |
| 5,666,424 | A | | 9/1997 | Fosgate et al. | 381/18 |
| 5,719,344 | A | * | 2/1998 | Pawate | 84/609 |
| 5,727,068 | A | | 3/1998 | Karagosian et al. | 381/22 |
| 5,778,082 | A | * | 7/1998 | Chu et al. | 381/92 |
| 5,890,125 | A | | 3/1999 | Davis et al. | 704/501 |
| 5,946,352 | A | | 8/1999 | Rowlands et al. | 375/242 |
| 6,021,386 | A | | 2/2000 | Davis et al. | 704/229 |
| 6,148,086 | A | * | 11/2000 | Ciullo et al. | 381/106 |
| 6,311,155 | B1 | * | 10/2001 | Vaudrey et al. | 704/225 |

OTHER PUBLICATIONS

International Search Report, ISA/US, Feb. 6, 2001, 6 pages.
"Two Microphone Nonlinear Frequency Domain Beamformer for Hearing Aid Noise Reduction," Lindemann, In *Proc. IEEE ASASP Workshop on app. of sig. proc. to audio and acous.*, New Paltz NY 1995.

* cited by examiner

*Primary Examiner*—William Korzuch
*Assistant Examiner*—Martin Lerner
(74) *Attorney, Agent, or Firm*—Townsend and Townsend and Crew LLP

(57) ABSTRACT

A method and apparatus for removing or amplifying voice or other signals panned to the center of a stereo recording utilizes frequency domain techniques to calculate a frequency dependent gain factor based on the difference between the frequency domain spectra of the stereo channels.

15 Claims, 2 Drawing Sheets

PROCESS FOR REMOVING VOICE FROM STEREO RECORDINGS

BACKGROUND OF THE INVENTION

The invention relates to the now very popular field of karaoke entertaining. In karaoke a (usually amateur) singer performs live in front of an audience with background music. One of the challenges of this activity is to come up with the background music, i.e. get rid of the original singer's voice to retain only the instruments so the amateur singer's voice can replace that of the original singer. A very inexpensive (but somewhat unsophisticated) way in which this can be achieved consists of using a stereo recording and making the assumption (usually true) that the voice is panned in the center (i.e. that the voice was recorded in mono and added to the left and right channels with equal level). In that case the voice can be significantly reduced by subtracting the left channel from the right channel, resulting in a mono recording from which the voice is nearly absent (because stereo reverberation is usually added after the mix a faint reverberated version of the voice is left in the difference signal). There are several drawbacks to this technique:

1) The output signal is always monophonic. In other words it is not possible using this standard technique to recover a stereo signal from which the voice has been removed.
2) More often than not, other instruments are also panned in the center (bass guitar, bass drum, horns and so on), and the standard technique will also remove them, which is undesirable.

The standard method does not allow extracting or amplifying the voice in the original recording: it is sometimes very useful to be able to remove the background instruments from the original recording and retain only the voice (for example, to change the mixing level of the voice or to aid a pitch-extraction system targeted at the voice).

SUMMARY OF THE INVENTION

According to one aspect of the present invention, a phase-vocoder removes the voice or the background instruments from a stereo recording while retaining a stereo output signal. Furthermore, because of the frequency-domain nature of the phase-vocoder, it is possible to more effectively discriminate, based on their frequency contents, the voice from other instruments also panned in the center.

According to a further aspect of the invention, peak frequencies are determined where the magnitude of the frequency domain spectra is at a maximum.

According to another aspect of the invention, a difference spectra is derived from the frequency domain spectra of the left and right stereo channels at the peak frequencies. An attenuating gain factor for each peak frequency is then calculated which is a function of the magnitude of the difference spectra at the peak frequency. For frequencies of voice signals, or other signals panned to center, the magnitude of difference spectra will be much less than that of the left or right channels.

According to another aspect of the invention, a modified spectra is derived by multiplying the magnitude of the frequency domain spectra by the attenuating gain factor at each peak frequency. The magnitude of the modified spectra at frequencies for voice, or other signals panned to center, will be small.

According to another aspect of the invention, the attenuation gain is set to unity for frequency components outside the voice range so that non-voice music panned to center is not attenuated.

According to another aspect of the invention, regions of influence are defined about each peak frequency. The magnitude of the frequency spectra within each region of influence is multiplied by the gain factor for the peak frequency.

According to another aspect of the invention, frequencies of voice, or of other signals panned to center, are amplified by utilizing an amplifying gain factor inversely proportional to the magnitude of the gain factor at each peak frequency. For example, the amplifying gain factor can be set equal to the difference of one and the attenuating gain factor.

Other features and advantages of the invention will be apparent in view of the following detailed description and appended drawings.

DESCRIPTION OF THE SPECIFIC EMBODIMENTS

Figure 1:
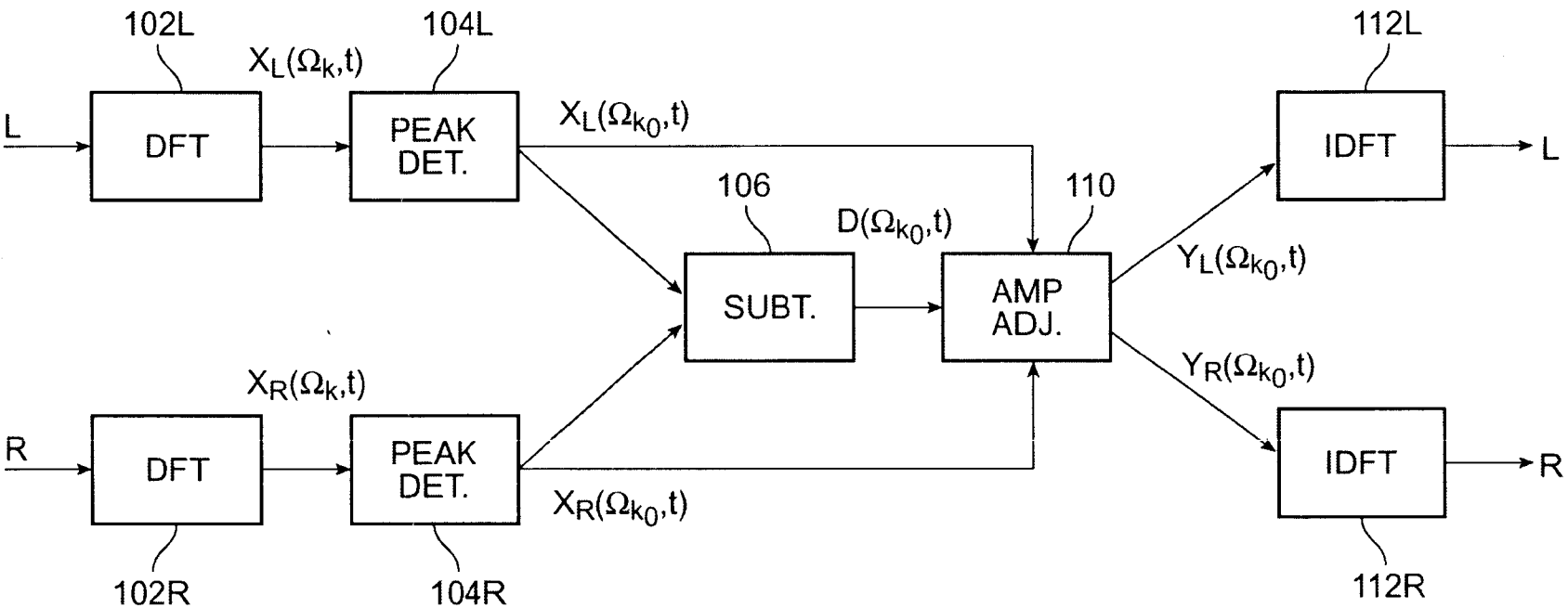
FIG. 1 is a block diagram depicting the steps performed by a preferred embodiment of the invention.

An overview of the present invention will now be described with reference to FIG. 1, which is a block diagram depicting the various operations and output signals. In FIG. 1, the left and right stereo channels of a stereo recording are input to discrete Fourier transform blocks 102L and R. In a preferred embodiment, the stereo channels will be in the form of digital signals. However, for analog stereo channels, the channels can be digitized using techniques well-known in the art.

The output of the DFT blocks 102L and R is the frequency domain spectra of the left and right stereo channels. Peak detection blocks 104L and R detect the peak frequencies at which peaks occur in the frequency domain spectra. This information is then passed to a subtraction block 106, which generates a difference spectra signal having values equal to the difference of the left and right frequency domain spectra at each peak frequency. If voice signals are panned to center, then the magnitudes and phases of the frequency domain spectra for each channel at voice frequencies will be almost identical. Accordingly, the magnitude of the difference spectra at those frequencies will be small.

The difference signal as well as the left and right peak frequencies and frequency domain spectra are input to an amplitude adjusting block 110. The amplitude adjustment block utilizes the magnitudes of the difference spectra and frequency domain spectra of each channel to modify the magnitudes of the frequency domain spectra of each channel and output a modified spectra. The magnitude of the modified spectra depends on the magnitude of the difference spectra. Accordingly, the magnitude of the modified frequency domain spectra will be low for frequencies corresponding to voice.

The modified frequency domain spectra for each channel is input to inverse discrete Fourier (IDFT) transform blocks 112L and R, which output time domain signals based on the modified spectra. Since the modified spectra was attenuated at frequencies corresponding to voice the modified stereo channels output by the IDFT, blocks 112L and R will have the voice removed. However, the instruments and other sounds not panned to the center will remain in the original stereo channels so that the stereo quality of the recording will be preserved.

Figure 2:
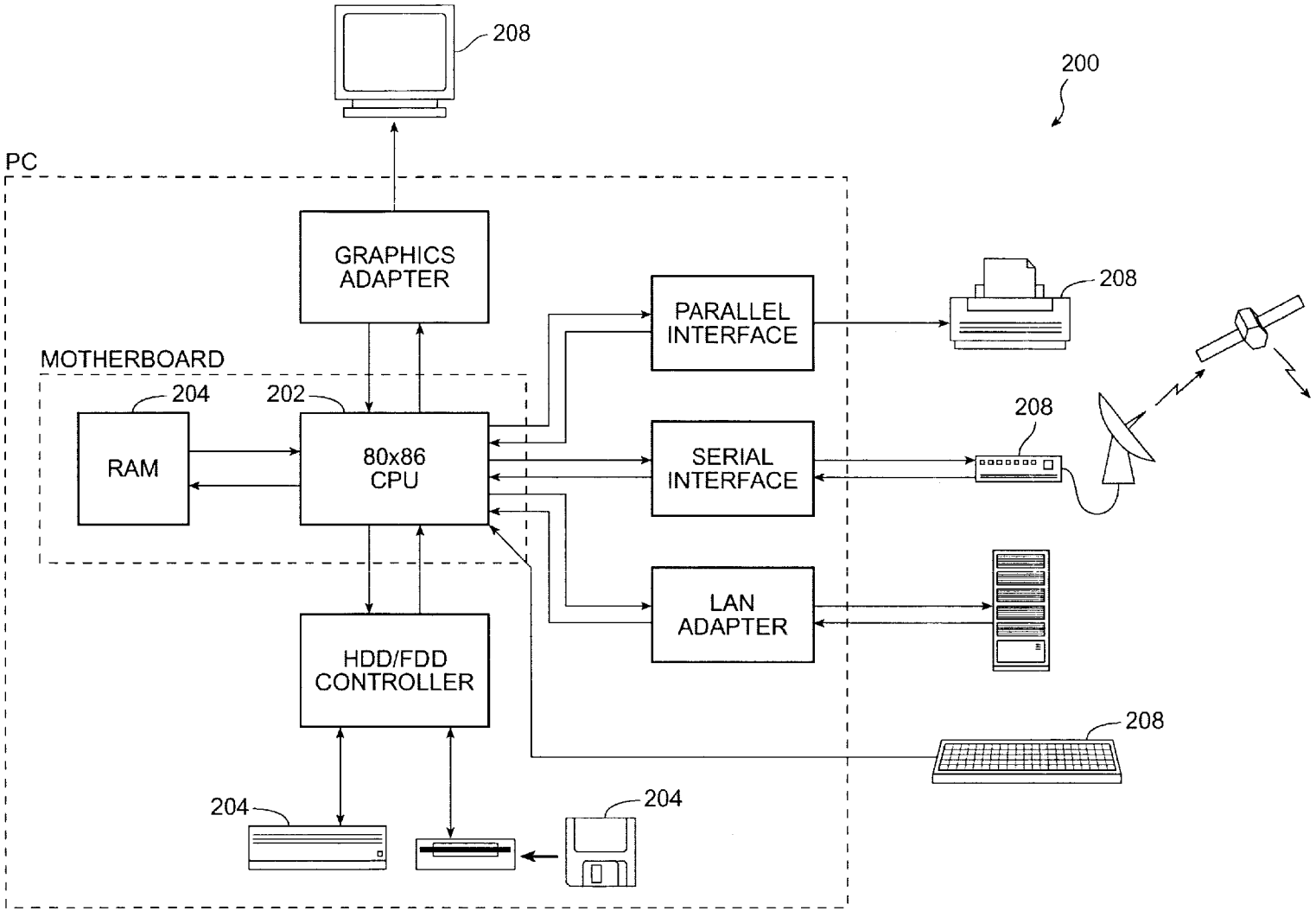
FIG. 2 is a block diagram of a computer system for implementing a preferred embodiment of the invention.

The above steps can be performed by hardware or software. FIG. 2 is a block diagram of a computer system 200, including a CPU 202, memory 204, and peripherals 208, capable of implementing the invention in software. In a preferred embodiment, the signal processing call be performed in a digital signal processor (DSP) (notshown) under control of the CPU.

The various steps performed by the blocks of FIG. 1 will now be described in greater detail.

The Phase Vocoder and DFT

A basic idea of the present invention is mimicking the behavior of the standard left-right algorithm in the frequency domain. A frequency-domain representation of the signal can be obtained by use of the phase-vocoder, a process in which an incoming signal is split into overlapping, windowed, short-term frames which are then processed by a Fourier Transform, resulting in a series of short-term frequency domain spectra representing the spectral content of the signal in each short-term frame. The frequency-domain representation can then be altered and a modified time-domain signal reconstructed by use of overlapping windowed inverse Fourier transforms. The phase vocoder is a very standard and well known tool that has been used for years in many contexts (voice coding high-quality time-scaling frequency-domain effects and so on).

Assuming the incoming stereo signal is processed by the phase-vocoder, for each stereo input frame there is a pair of frequency-domain spectra that represent the spectral content of the short-term left and right signals. The short-term spectrum of the left signal is denoted by $X_L(\Omega_k,t)$, where $\Omega_k$ is the frequency channel and t is the time corresponding to the short-time frame. Similarly, the short-term spectrum of the right signal is denoted by $X_R(\Omega_k,t)$. Both $X_L(\Omega_k,t)$ and $X_R(\Omega_k,t)$ are arrays of complex numbers with amplitudes and phases.

Peak Detection

The first step consists of identifying peaks in the magnitudes of the short-term spectra. These peaks indicate locally sinusoidal components that can either belong to the voice or to the background instruments. To find the peaks, one calculates the magnitude of $X_L(\Omega_k,t)$ or of $X_R(\Omega_k,t)$ or of $X_L(\Omega_k,t)+X_R(\Omega_k,t)$ and one performs a peak detection process. One such peak detection scheme consists of declaring as peaks those channels where the amplitude is larger than the two neighbors on the left and the two neighbors on the right. Associated with each peak is a so called region of influence composed of all the frequency channels around the peak. The consecutive regions of influence are contiguous and the limit between two adjacent regions can be set to be exactly mid-way between two consecutive peaks or to be located at the channel of smallest amplitude between the two consecutive peaks.

Difference Calculation and Gain Estimation

The Left-Right difference signal in the frequency domain is obtained next by calculating the difference between the left and right spectra using:

$$D(\Omega_{k_0},t)=X_L(\Omega_{k_0},t)-X_R(\Omega_{k_0}t) \tag{1}$$

for each peak frequency $\Omega_{k_0}$.

For peaks that correspond to components belonging to the voice (or any instrument panned in the center) the magnitude of this difference will be small relative to either $X_L(\Omega_{k_0},t)$ or $X_R(\Omega_{k_0},t)$, while for peaks that correspond to components belonging to background instruments this difference will not be small. Using $D(\Omega_{k_0},t)$ to reconstruct the time-domain signal would result in the exact equivalent of the standard Left-Right algorithm with a mono output.

Rather, the key idea is to calculate how much of a gain reduction it takes to bring $X_L(\Omega_{k_0},t)$ and $X_R(\Omega_{k_0},t)$ down to the level of $D(\Omega_{k_0},t)$ and apply this gain in the frequency domain, leaving the phases unchanged. Specifically the left and right gains are calculated as follows:

$$\Gamma_L(\Omega_{k_0},t)=\min(1,|D(\Omega_{k_0},t)|/|X_L(\Omega_{k_0},t)|)$$

and $$\Gamma_R(\Omega_{k_0},t)=\min(1,D(\Omega_{k_0},t)|/|X_R(\Omega_{k_0},t)|)$$

which are the left gain and the right gain for each peak frequency. The mino function assures that these gains are not allowed to become larger than 1. Peaks for which $\Gamma_L(\Omega_{k_0},t)$ is close to 0 are deemed to correspond to the voice while peaks for which $\Gamma_L(\Omega_{k_0},t)$ is close to 1 are deemed to correspond to the background instruments.

Voice Removal

To remove the voice one will apply a real gain $G_{L,R}(\Omega_{k_0},t)$ to all the channels in the region of influence of the peak:

$$Y_L(\Omega_{k_0},t)=X_L(\Omega_{k_0},t)G_L(\Omega_{k_0},t)$$

$$Y_R(\Omega_{k_0},t)=X_R(\Omega_{k_0},t)G_R(\Omega_{k_0},t).$$

The gains $G_{L,R}(\Omega_{k_0},t)$ are real, and therefore the modified channels $Y_{L,R}(\Omega_{k_0},t)$ have the same phase as the original channels $X_{L,R}(\Omega_{k_0},t)$ but their magnitudes have been modified.

To remove the voice, $G_{LR}(\Omega_{k_0},t)$ should be small whenever $\Gamma_{LR}(\Omega_{k_0},t)$ is small and should be close to 1 whenever $\Gamma_{L,R}(\Omega_{k_0},t)$ is close to 1.

One choice is $$G_{L,R}(\Omega_{k_0},t)=\Gamma_{L,R}(\Omega_{k_0},t)$$

where the modified channels $Y_{L,R}(\Omega_{k_0},t)$ are given the same magnitude as the difference $D(\Omega_{k_0},t)$. As a result the signal reconstructed from $Y_L(\Omega_{k_0},t)$ and $Y_R(\Omega_{k_0},t)$ will retain the stereo image of the original signal but the voice components will have been significantly reduced.

Another choice is $$G_{L,R}(\Omega_{k_0},t)=(\Gamma_{L,R}(\Omega_{k_0},t))^{\alpha}$$

with $\alpha>0.\alpha$ controls the amount of reduction brought by the algorithm: $\alpha$ close to 0 does not remove much while large values of $\alpha$ remove more and $\alpha=1$ removes exactly the same amount as the standard Left-Right technique. Using large values of $\alpha$ makes it possible to attain a larger amount of voice removal than possible with the standard technique.

In general, the gain function is a function based on the magnitude of the difference spectra.

Voice Amplification

To amplify the voice and attenuate the background instruments the gains $G_{L,R}(\Omega_{k_0},t)$ should be chosen to be close to 1 for small $\Gamma_{L,R}(\Omega_{k_0},t)$ and close to 0 for $\Gamma_{L,R}(\Omega_{k_0},t)$ close to 1, i.e., an increasing function of the inverse of the magnitude. Examples include:

$$G_{L,R}(\Omega_{k_0},t)=1-\Gamma_{L,R}(\Omega_{k_0},t)$$

or $$G_{L,R}(\Omega_{k_0},t)=(1-\Gamma_{L,R}(\Omega_{k_0},t))/(1\pm\Gamma_{L,R}(\Omega_{k_0},t))$$

etc. Because $G_{L,R}(\Omega_{k_0},t)$ is small for channels that belong to background instruments (for which $\Gamma_{L,R}(\Omega_{k_0},t)$ is close to 1), background instruments are attenuated while the voice is left unchanged.

Gain Smoothing

It is often useful to perform time-domain smoothing of the gain values to avoid erratic gain variations that can be perceived as a degradation of the signal quality. Any type of smoothing can be used to prevent such erratic variations. For example, one can generate a smoothed gain by setting $$\hat{G}_{L,R}(\Omega_{k_0},t)=\beta G_{L,R}(\Omega_{k_0},t)-(1-\beta)\hat{G}_{L,R}(\Omega_{k_0},t-1)$$

where β is a smoothing parameter between 0 (a lot of smoothing) and 1 (no smoothing) and (t−1) denotes the time at the previous frame and Ĝ is the smoothed version of G. Other types of linear or non-linear smoothing can be used.

Frequency Selective Processing

Because the voice signal typically lies in a reduced frequency range (for example from 100 Hz to 4 kHz for a male voice) it is possible to set the gains $G_{L,R}(\Omega_{k_0},t)$ to arbitrary values for frequency outside that range. For example, when removing the voice we can assume that there are no voice components outside of a frequency range $\omega_{min}\rightarrow\omega_{max}$ and set the gains to 1 for frequency outside that range:

$$G_{L,R}(\Omega_{k_0},t)=1 \text{ for } \Omega_{k_0}<\omega_{min} \text{ or } \Omega_{k_0}>\omega_{max}.$$

Thus, components belonging to an instrument panned in the center (such as a bass-guitar or a kick drum) but whose spectral content do not overlap that of the voice, will not be attenuated as they would with the standard method.

For voice amplification one could set those gains to 0:

$$G_{L,R}(\Omega_{k_0},t)=0 \text{ for } \Omega_{k_0}<\omega_{min} \text{ or } \Omega_{k_0}>\omega_{max}$$

so that instruments falling outside the voice range would be removed automatically regardless of where they are panned.

Left/Right Balance

Sometimes the voice is not panned directly in the center but might appear in both channels with a small amplitude difference. This would happen, for example, if both channels were transmitted with slightly different gains. In that case, the gain mismatch can easily be incorporated in Eq. (1):

$$D'(\Omega_{k_0},t)=\delta X_L(\Omega_{k_0},t)-X_R(\Omega_{k_0},t)$$

where δ is a gain adjustment factor that represents the gain ratio between the left and right channels.

IDFT and Signal Reconstruction

Once $Y_L(\Omega_{k_0},t)$ and $Y_R(\Omega_{k_0},t)$ have been reconstructed for every frequency channels, the resulting frequency domain representation is used to reconstruct the time-domain signal according to the standard phase-vocoder algorithm.

The invention has now been described with reference to the preferred embodiments. Alternatives and substitutions will now be apparent to persons of skill in the art. Accordingly, it is not intended to limit the invention except as provided by the appended claims.

What is claimed is:

1. A method, performed by a computer, for removing voice from a stereo recording including first and second stereo channels, said method comprising the steps of:

splitting the first and second stereo channels of the stereo recording into overlapping, windowed, short-term frames;

processing said frames into a series of short-term frequency domain spectra representing the spectral content of the first and second stereo channels in each short-term frame;

locating a plurality of peak frequencies at which maxima occur in the frequency domain spectra for each stereo channel;

forming a difference spectra, at each peak frequency, equal to the difference between the frequency domain spectra of the first and second stereo channels at the same peak frequency, where the size of the difference spectra is small for frequencies of voice or other instruments panned to the center of the first and second stereo channels; and multiplying the magnitude of the frequency domain spectra at each peak frequency by a gain factor being a function of the magnitude of the difference spectra at the same peak frequency so that frequency components of voice signals panned to the center of the stereo channels are reduced in magnitude.

2. The method of claim 1, where said step of locating peak frequencies comprises:

associating a region of influence with each peak frequency;

and with said step of multiplying including multiplying the magnitude of the frequency domain spectra within the region of influence for each peak frequency by the gain factor.

3. The method of claim 1, further comprising the step of:

setting the gain factor, at a specific peak frequency, equal to the ratio of the magnitude of the difference spectra to the magnitude of the frequency domain spectra at the specific peak frequency.

4. The method of claim 1, further comprising the step of:

setting the gain factor, at a specific peak frequency, equal to the ratio of the magnitude of the difference spectra to the magnitude of the frequency domain spectra at the specific peak frequency raised to a power having a size larger than zero.

5. The method of claim 1, further comprising the step of:

setting said gain factor to unity for peak frequencies outside the range of voice frequencies so that the volume of background instruments is not attenuated.

6. The method of claim 1, where said step of processing said frames further comprises the step of:

performing a Fourier transform on each frame.

7. A method, performed by a computer, for amplifying voice in a stereo recording including first and second stereo channels, said method comprising the steps of:

splitting the first and second stereo channels of the stereo recording into overlapping, windowed, short-term frames;

processing said frames into a series of short-term frequency domain spectra representing the spectral content of the first and second stereo channels in each short-term frame;

locating a plurality of peak frequencies at which maxima occur in the frequency domain spectra for each stereo channel;

forming a difference spectra, at each peak frequency, equal to the difference between the frequency domain spectra of the first and second stereo channels at the same peak frequency, where the size of the difference spectra is small for frequencies of voice or other instruments panned to the center of the first and second stereo channels; and multiplying the magnitude of the frequency domain spectra at each peak frequency by a gain factor that varies according to an increasing function of the inverse of the magnitude of the difference spectra at the same peak frequency so that frequency components of voice signals panned to the center of the stereo channels are increased in magnitude.

8. The method of claim 7 further comprising the step of:

setting the gain factor equal to the difference of one and the ratio of the magnitude of the difference spectra and frequency domain spectra for each peak frequency.

9. The method of claim 7 where said step of locating peak frequencies comprises:

associating a region of influence with each peak frequency;

and with said step of multiplying including multiplying the magnitude of the frequency domain spectra within the region of influence for each peak frequency by the gain factor.

10. The method of claim 7 further comprising the step of:

setting said gain factor to zero for peak frequencies outside the range of voice frequencies so that the volume of background instruments is attenuated.

11. The method of claim 7 where said step of processing said frames further comprises the step of:

performing a Fourier transform on each frame.

12. A computer program product for removing voice from the first and second stereo channels of a stereo recording comprising:

a computer readable storage structure having computer program code embodied therein, said computer program code including:

computer program code for splitting the first and second stereo channels of the stereo recording into overlapping, windowed, short-term frames;

computer program code for processing said frames by a Fourier Transform resulting in a series of short-term frequency domain spectra representing the spectral content of the first and second stereo channels in each short-term frame;

computer program code for locating a plurality of peak frequencies at which maxima occur in the frequency domain spectra for each stereo channel;

computer program code for forming a difference spectra, at each peak frequency, equal to the difference between the frequency domain spectra of the first and second stereo channels at the same peak frequency, where the size of the difference spectra is small for frequencies of voice or other instruments panned to the center of the first and second stereo channels; and computer program code for multiplying the magnitude of the frequency domain spectra at each peak frequency by a gain factor being a function of the magnitude of the difference spectra at the same peak frequency so that frequency components of voice signals panned to the center of the stereo channels are reduced in magnitude.

13. A computer program product for amplifying voice in a stereo recording including first and second stereo channels, said computer program product comprising:

a computer readable storage structure having computer program code embodied therein, said computer program code including:

computer program code for splitting the first and second stereo channels of the stereo recording into overlapping, windowed, short-term frames;

computer program code for processing said frames by a Fourier Transform resulting in a series of short-term frequency domain spectra representing the spectral content of the first and second stereo channels in each short-term frame;

computer program code for locating a plurality of peak frequencies at which maxima occur in the frequency domain spectra for each stereo channel;

computer program code for forming a difference spectra, at each peak frequency, equal to the difference of the frequency domain spectra of the first and second stereo channels at the same peak frequency, where the size of the difference spectra is small for frequencies of voice or other instruments panned to the center of the first and second stereo channels; and computer program code for multiplying the magnitude of the frequency domain spectra at each peak frequency by a gain factor being an increasing function of the inverse of the size of the magnitude of the difference spectra at the same peak frequency so that frequency components of voice signals panned to the center of the stereo channels are increased in magnitude.

14. A method, performed by a computer, for removing voice from a stereo recording including first and second stereo channels, said method comprising the steps of:

splitting the first and second stereo channels of the stereo recording into windowed, short-term frames;

processing said frames into a series of short-term frequency domain spectra representing the spectral content of the first and second stereo channels in each short-term frame;

locating a plurality of peak frequencies at which maxima occur in the frequency domain spectra for each stereo channel;

forming a difference spectra, at each peak frequency, equal to the difference between the frequency domain spectra of the first and second stereo channels at the same peak frequency, where the size of the difference spectra is small for frequencies of voice or other instruments panned to the center of the first and second stereo channels; and multiplying the magnitude of the frequency domain spectra at each peak frequency by a gain factor being a function of the magnitude of the difference spectra at the same peak frequency so that frequency components of voice signals panned to the center of the stereo channels are reduced in magnitude.

15. A computer program product for removing voice from the first and second stereo channels of a stereo recording comprising:

a computer readable storage structure having computer program code embodied therein, said computer program code including:

computer program code for splitting the first and second stereo channels of the stereo recording into windowed, short-term frames;

computer program code for processing said frames by a Fourier Transform resulting in a series of short-term frequency domain spectra representing the spectral content of the first and second stereo channels in each short-term frame;

computer program code for locating a plurality of peak frequencies at which maxima occur in the frequency domain spectra for each stereo channel;

computer program code for forming a difference spectra, at each peak frequency, equal to the difference between the frequency domain spectra of the first and second stereo channels at the same peak frequency, where the size of the difference spectra is small for frequencies of voice or other instruments panned to the center of the first and second stereo channels; and computer program code for multiplying the magnitude of the frequency domain spectra at each peak frequency by a gain factor being a function of the magnitude of the difference spectra at the same peak frequency so that frequency components of voice signals panned to the center of the stereo channels are reduced in magnitude.

* * * * *